United States Patent [19]

Simpson

[11] 3,999,804

[45] Dec. 28, 1976

[54] LONGWALL MINING WITH CHAIN PILLAR RECOVERY

[75] Inventor: Terry Lee Simpson, Westminster, Calif.

[73] Assignee: Atlantic Richfield Company, Los Angeles, Calif.

[22] Filed: Mar. 8, 1976

[21] Appl. No.: 664,438

[52] U.S. Cl. ..... 299/11; 299/19

[51] Int. Cl.[2] ..... E21C 41/00

[58] Field of Search ..... 299/11, 33, 19

[56] References Cited

UNITED STATES PATENTS

| | | | |
|---|---|---|---|
| 2,358,687 | 9/1944 | Cassidy et al. | 299/19 X |
| 3,892,442 | 7/1975 | Janssen | 299/11 |

*Primary Examiner*—Ernest R. Purser

*Attorney, Agent, or Firm*—Robert M. Betz

[57] ABSTRACT

In a longwall mining system, a work face extends between parallel sets of multiple head- and tailgate entries, adjacent entries of each set being separated by rows of chain pillars. Lengths of a headgate entry immediately adjacent the longwall panel and the pillar breakthroughs to the next headgate entry are progressively pump packed in advance of the longwall face with a coherent thixotropic roof supporting material. As the longwall face is mined, a bidirectional shearing machine cuts through the roof supporting material and the chain pillars, which are then removed in a continuous operation.

10 Claims, 3 Drawing Figures

LONGWALL MINING WITH CHAIN PILLAR RECOVERY

BACKGROUND OF THE INVENTION

1. Field of the Invention

This invention relates generally to the field of longwall mining and more particularly to a method for recovery of chain pillars separating development entries adjacent a longwall or panel to be mined.

2. Description of the Prior Art

Longwall mining in the United States requires that areas to be mined are typically blocked out by a system of parallel entries variously used for the passage of fresh and return air, belt conveyors or electrical cables. With the enactment of various Federal and state mining laws since 1969, the minimum number of adjacent entries that can presently be developed without "special permits" is two, and frequently sets of three or more are employed. Conventionally, the longwall mining face extends from outboard entry to outboard entry of a development panel. As the panel is mined in retreat, considerable coal is lost in the rows of chain pillars that remain standing subsequent to the mining operation. This practice not only wastes valuable resource but can also cause considerable ground pressure-related problems in the tailgate entry of succeeding panels.

In the past, temporary or permanent roof supports such as wooden cribs or posts have been installed in the development entries and crosscuts to allow mining through the entry and its adjacent pillars. However, this has been done only to alleviate adverse mining conditions or to facilitate production in a specific local area of the mine. Furthermore, such supports must either be removed by hand or if left in place they slow down the mining machines. Consequently, such methods have not been used longer than necessary to escape the region in which the particular problem exists. In view of this prior art, the inventor sought to develop a method for removal of chain pillars during and as an integral part of a longwall mining operation without impairing production or creating hazardous conditions.

A known technique adaptable to longwall mining is that of "pump packing" which is described in a paper entitled "Review of British and American Coal Mining Technology", prepared for presentation at the AIME annual meeting, New York, New York, Preprint No. 75-F-76. Pump packing, as described in this publication, involves mixing broken coal or other minerals with a binder such as bentonite and water to form a thixotropic material. This material flows under pressure and solidifies rapidly when the pressure is relieved. It has been used by the British to construct separate pack walls. As noted in the reference paper, it has also been used in filling an entry intersecting a longwall panel. Its low strength is said to facilitate cutting through the filled entry by a shearer so that the longwall advance is not interrupted. Thus, pump packing is seen to be a convenient technique for providing a "natural" or homogeneous roof support and as such facilitates the practice of method to be described. Sofar as the inventor is aware, however, pump packing has not been used or suggested as an integral part of a continuous mining operation involving chain pillar recovery.

The invention to be described is of particular utility in the underground mining of thick mineral seams, by which is meant herein seams too thick to work effectively as a single conventional lift with available machinery and supports. In accordance with a known method, thick seam mining in Europe involves driving parallel development entries into the bottom of the sea to form a longwall. The solid face is cut with a bidirectional drum shearer which loads an armored face conveyor. This operation proceeds under the protection of a row of adjacent mine roof supports each extending transverse to the solid face. As the shearer passes each position along the face, the roof supports are progressively advanced to support the roof while mineral from overlying strata on the gob side is allowed to cave for subsequent loading on a gob conveyor. The redesign of existing minor roof support structures for use in this type of mining and their integration in a system for such mining is the subject of a separate invention. These features are detailed in commonly assigned application Ser. No. 664,437, entitled MINE ROOF SUPPORT AND METHOD IN THICK SEAM LONGWALL MINING filed concurrently herewith. The chain pillar problems referenced above in conventional U.S. longwalling are of equal if not greater concern in the mining of these thick seams. In such mining the greater share of mineral recovery is derived from caving and loading of broken mineral. Recovery of chain pillars in longwalling a thick seam will be seen to enhance the amount of recovery of caved coal. Also, where such a thick seam is mined in two or more lifts, chain pillar removal is particularly helpful in destressing the roof of lower lifts.

SUMMARY OF THE INVENTION

Accordingly, it is a general object of this invention to provide an improved longwall mining system which permits greater mineral recovery.

It is another object of this invention to provide an improved thick seam longwall mining system.

It is a further object of this invention to provide an improved longwall mining system which minimizes the presence of remaining voids after the mining operation is completed.

It is yet another object of this invention to provide an improved longwall mining system wherein chain pillars separating adjacent development entries are mined and removed.

It is still another object of this invention to provide an improved longwall mining system which maximizes the amount of coal recovered in each pass and correspondingly minimizes the time lost in moving the necessary longwall mining equipment.

In accordance with one embodiment of this invention, a longwall mining system includes the steps of driving sets of parallel, adjacent development entries separated by rows of chain pillars on either side of a longwall panel to establish a longwall face in a seam of coal or other mineral, progressively packing, lengths of at least one development entry and its crosscuts adjacent the longwall panel in advance of the longwall mining face with a coherent thixotropic flowable roof supporting material, and thereafter mining the panel and at the same time mining and removing the packed material and the chain pillars in a continuous bidirectional mining operation with other mined material

DESCRIPTION OF THE PREFERRED EMBODIMENTS

Figure 1:
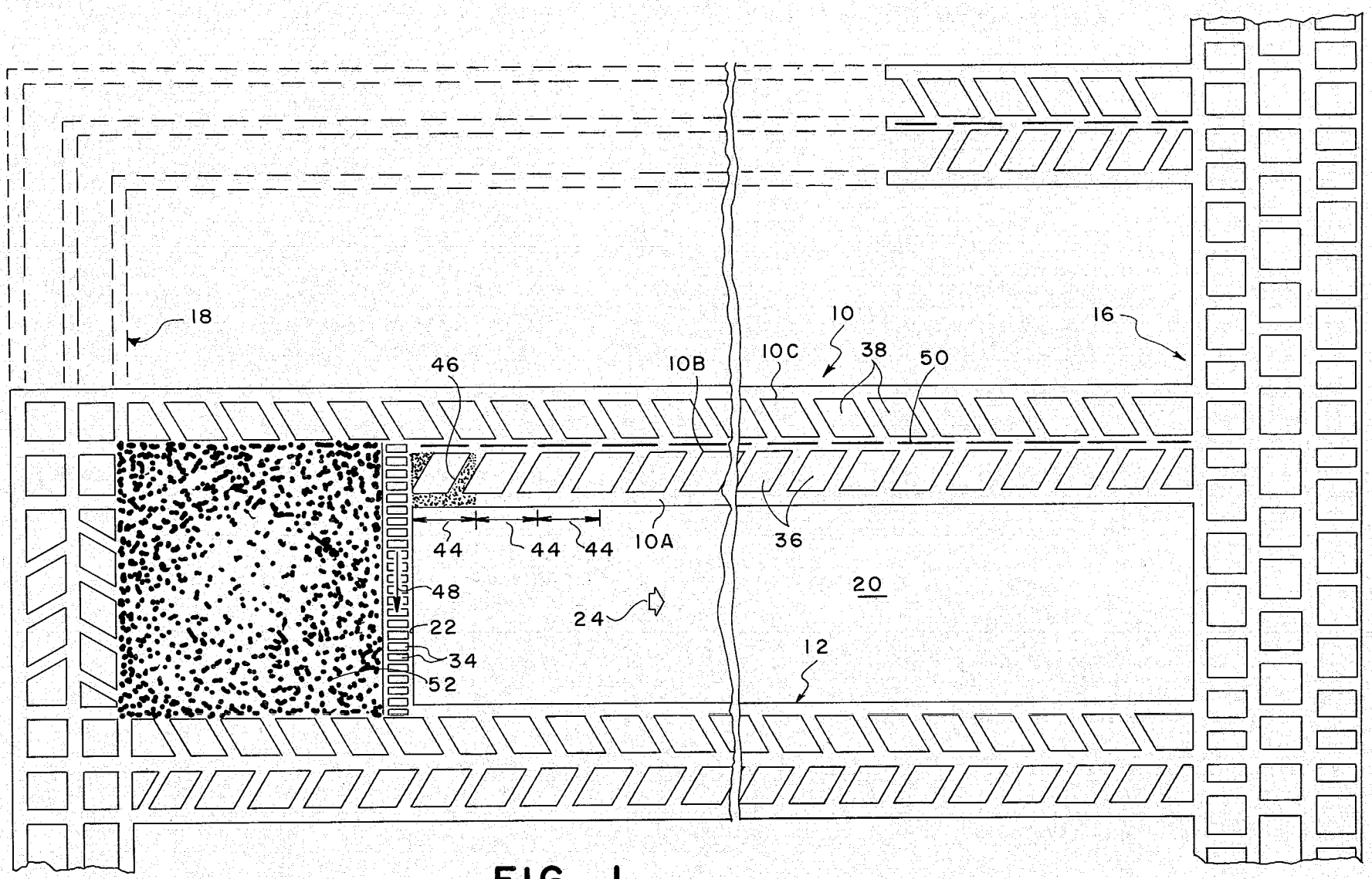
FIG. 1 is a diagrammatic plan view of an underground mine development in accordance with this invention.
Figure 2:
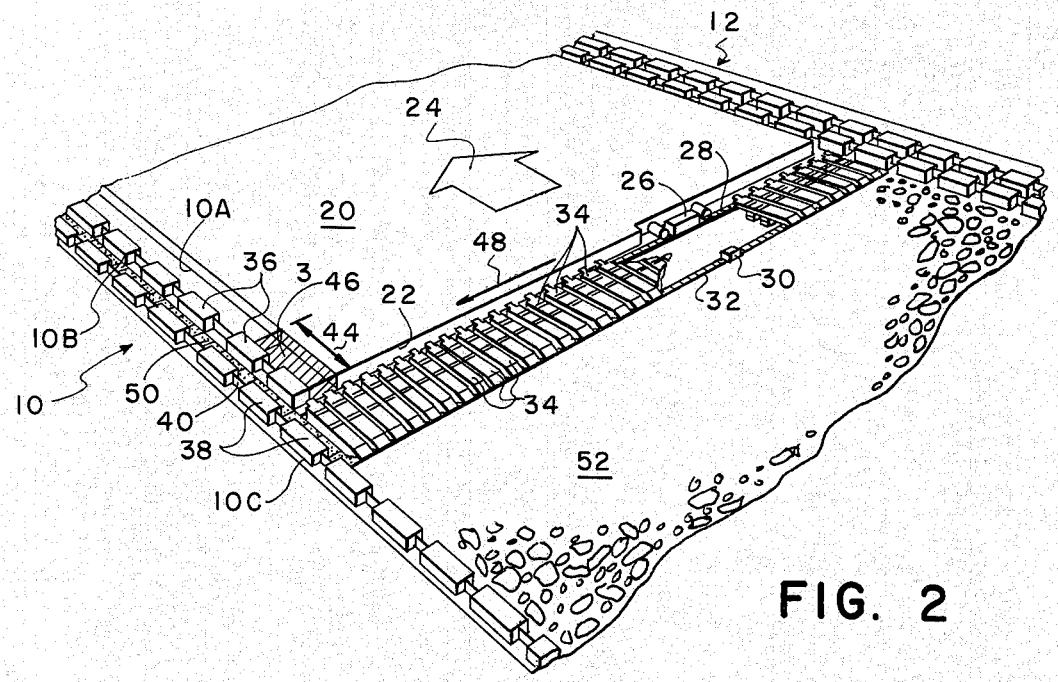
FIG. 2 is a diagrammatic perspective view of the mine development of FIG. 1.
Figure 3:
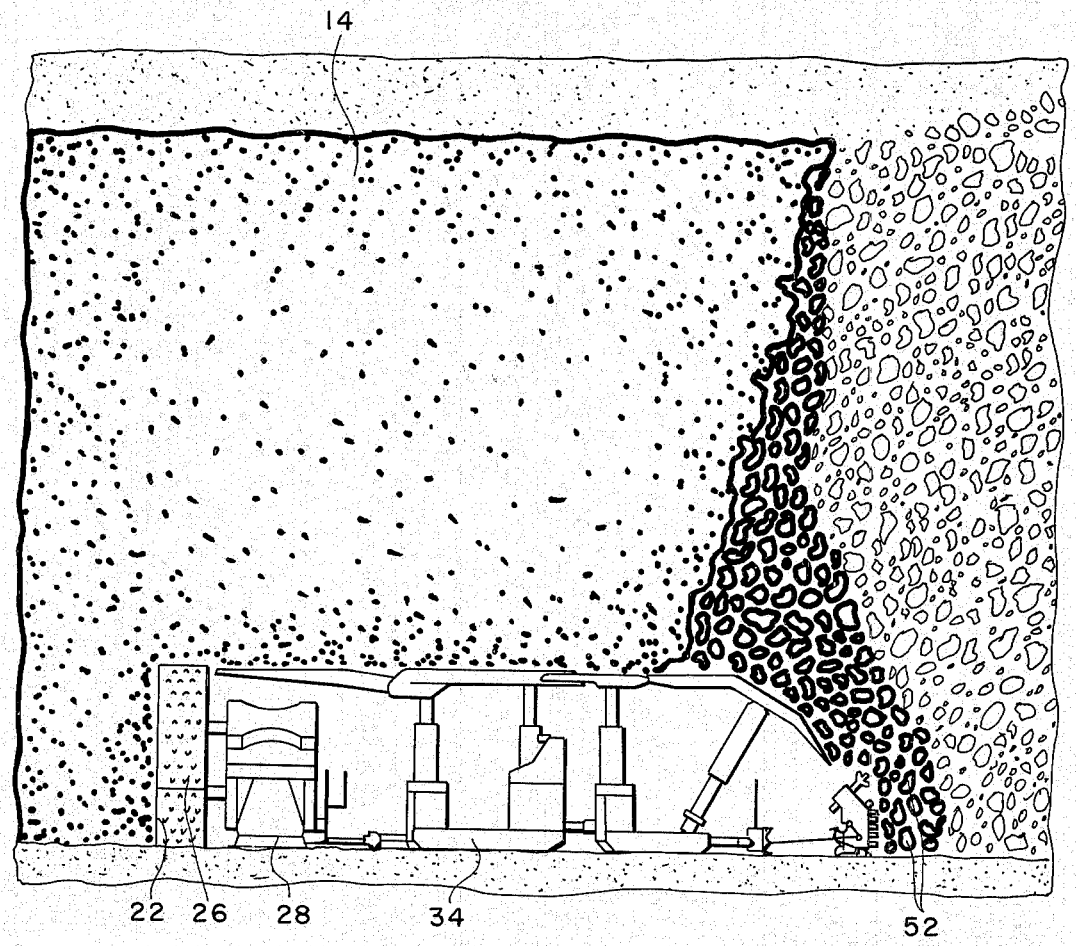
FIG. 3 is a vertical cross-sectional view through a thick mineral seam illustrating longwall equipment employed in the practice of this invention.

Referring now to FIGS. 1, 2 and 3 there is shown a preferred embodiment of the practice of the invention. Two or more sets of parallel subterranean panel entries, such as entries 10 and 12, are driven into the bottom of a thick seam 14 of coal or other mineral between sets of main entries 16 and butt entries 18 to block out a panel 20 of coal or other mineral to be mined. The panel 20 is shown as it appears after mining has begun so that the longwall face 22 has receded in the direction of retreat indicated by arrow 24. The face 22 is mined by a conventional bidirectional double drum shearer 26 which breaks coal from the face 22 and loads it onto a face conveyor 28. A plow 30 loads a gob conveyor 32 installed on the gob side of the self-advancing roof supports 34. As the face 22 is mined laterally and the roof supports 34 are progressively advanced, the remaining coal and overlying strata are allowed to cave on the gob side. Broken coal is loaded on the gob conveyor 32 for transport from the mine. The general mode of operation of the roof supports 34 forms part of a separate invention as more particularly described in above-referenced application, Ser. No. 664,437.

The panel 20, which is illustrative of a continuing series of such panels is developed so that entries 10 and 12 function respectively as headgate and tailgate entries for coal haulage, ventilation and men and material access. Second and successive panels, such as panel 21, will be established adjacent the panel 20 and the mining process repeated.

As best seen in FIG. 1, the set of entries 10 consist of individual adjoining entries 10A, 10B and 10C which are separated by parallel rows of adjacent chain pillars 36 and 38, interconnected with stoppings 40, either of a temporary or permanent construction.

In advance of the longwall face 22, a selected length 44 of the entry 10A is filled or "packed" with a thixotropic mixture or slurry 46 of coal and soft binding agent such as bentonite. A wooden or cloth form (not shown) is used to hold the slurry 46 until it solidifies. The stoppings 40 can function as a part of this form.

The location of the conventional equipment (not shown) with which to accomplish the packing of entry 10A is not critical and forms no part of this invention. It may, for example, be placed within the entry 10A or even on the tailgate side of the panel 20 with a supply hose being brought along the face 22 to the entry 10A.

When the shearer 26 has advanced laterally in the direction of the arrow 48 to the edge of the panel 20, it cuts or plows through the roof supporting packing 46 without interruption and continues on through the chain pillars 36. The packing material 46 and the pillars 36 are then removed by means of the face conveyor 28 which feeds into the belt conveyor 50 moving along the entry 10B.

Once the mining operation has begun, the row of roof supports 34 are extended laterally until they occupy the space previously filled by the chain pillars 36. Thus, the collapsed gob 52 behind the advancing roof supports 34 includes the mineral above the filled entry 10A and the removed chain pillars 36. As the row of pillars 36 are removed, the entry 10B will begin to collapse while pillars 38 remain in place to protect entry 10C.

The process described above is continued by progressively packing incremental lengths 44 of the entry 10A in the retreat direction 24, mining through the packed entry and the adjacent chain pillars 36. This procedure increases the overall mineral recovery and improves the conditions in the remaining entry 10C when it becomes the tailgate entry in the next panel 20.

The procedure may clearly be employed to mine and remove any number of adjacent rows of chain pillars, by packing the associated entries and breakthroughs. The fewer the number of remaining adjacent rows of pillars the greater the likelihood that the resulting "pressure arch" will span over to the adjacent solid mineral panel 20, thereby avoiding pressure buildup in the chain pillars. If the row of pillars are left standing between adjacent panels, caving may be expected on both sides of the row, thus leaving a minimum of open voids in the mined area. With the aid of this technique, it should be possible to recover at least 60% of the mineral within the boundaries of a mining layout.

The technique is not limited to use in a deep, thick seam mining operation since the chain pillar mining and recovery proceed independently of the recovery of broken mineral on the gob side.

While a preferred embodiment of this invention has been described, it will be understood that various changes and modifications can be introduced in the overall mining plan and in the equipment employed without departing from the spirit and scope of such invention as set forth in the claims appended hereto.

The embodiments of the invention in which an exclusive property or privilege is claimed are defined as follows:

1. In a longwall mining operation wherein a work face of a panel to be mined in a mineral deposit extends between parallel sets of multiple headgate and tailgate entries separated by rows of chain pillars, the improvement comprising:

a. progressively filling at least one entry and its adjoining cross-cuts in advance of the longwall face with a coherent roof supporting material and b. mining the work face together with the roof supporting material and the chain pillars in a continuous operation.

2. The method of claim 1 wherein said mineral is coal.

3. The method of claim 1 wherein said supporting material is provided by pump packing.

4. The method of claim 2 wherein said roof supporting material is a thixotropic mixture of mineral, binder and water.

5. The method of claim 2 wherein said chain pillars are interconnected with stoppings across said cross-cuts, which act as a form for said roof supporting material.

6. The method of claim 1 wherein said rows of chain pillars are mined bidirectionally.

7. The method of claim 1 wherein said longwall mining operation is employed to mine a thick subsurface mineral seam with induced sublevel caving.

8. The method of claim 1 wherein all but two of said set of multiple headgate entries are filled and all but one of said rows of chain pillars are removed.

9. The method of claim 1 wherein said panel is mined in retreat.

10. The method of mining subterranean thick seam mineral deposits which comprises:

a. driving substantially parallel sets of multiple development entries into the base of the mineral deposit, leaving rows of chain pillars separating adjacent entries, and interconnecting all said entries by at least one primary passage so as to define a panel to be mined, b. supporting the roof of the primary passage by means of self-advancing roof supporting structures, c. filling successive lengths of at least one of said entries adjacent said longwall panel with a coherent roof supporting material, d. mining in a continuous, bi-directional operation the exposed longwall face of the panel, the lengths of filled entry and the pillars adjacent thereto under the protection of the roof supporting structures, e. removing the mined mineral, f. advancing the roof supporting structures to the mined face as it recedes so as to effect caving of the previously supported roof on the gob side of the supporting structures, and g. recovering the caved mineral.

* * * * *